United States Patent [19]

Grunert et al.

[11] Patent Number: 4,963,846

[45] Date of Patent: Oct. 16, 1990

[54] TRIP INTERLOCK DESIGN

[75] Inventors: Kurt A. Grunert, Beaver; Ronald A. Cheski, Stowe Township, Allegheny County; Robert J. Tedesco, Coraopolis; Michael J. Whipple, New Sewickley; Melvin A. Carrodus, Brighton Township, Beaver County; James G. Maloney, Industry, all of Pa.

[73] Assignee: Westinghouse Electric Corp., Pittsburgh, Pa.

[21] Appl. No.: 389,849

[22] Filed: Aug. 4, 1989

[51] Int. Cl.[5] ..... H01H 75/10

[52] U.S. Cl. ..... 335/42; 335/172; 361/342

[58] Field of Search ..... 335/8–10, 335/202, 172–176, 42; 361/342; 200/50 B, 50 C

[56] References Cited

U.S. PATENT DOCUMENTS 2,805,294 9/1957 Edmunds ..... 200/50 B

*Primary Examiner*—Leo P. Picard
*Assistant Examiner*—Lincoln Donovan
*Attorney, Agent, or Firm*—M. J. Moran

[57] ABSTRACT

A trip interlock assembly trips a circuit breaker any time the circuit breaker is removed from its panel mounting. The trip assembly is adapted to be disposed about a load side terminal and cooperate with the circuit breaker tripping device. In one embodiment, the trip assembly includes a housing and a spring-loaded actuation arm, disposed generally perpendicular to the circuit panel surface. The actuation arm is formed with a cam surface which cooperates with a trip pin adapted to actuate said circuit breaker tripping device. The trip pin acts as a cam follower and rides along the cam surface formed in the actuation arm. When the actuation arm is in an inward position the trip pin is in a normal position. However, when the circuit breaker is removed from the panel, the actuation arm under the influence of a biasing spring moves outwardly. This causes the cam surface on the actuation arm to actuate the trip pin to trip the circuit breaker. In an alternative embodiment of the invention, the trip interlock assembly includes a bell crank with a reciprocally mounted plunger which actuates an armature in the tripping device directly, instead of by way of the trip pin, anytime the circuit breaker is removed from its panel housing.

19 Claims, 3 Drawing Sheets

Fig-10
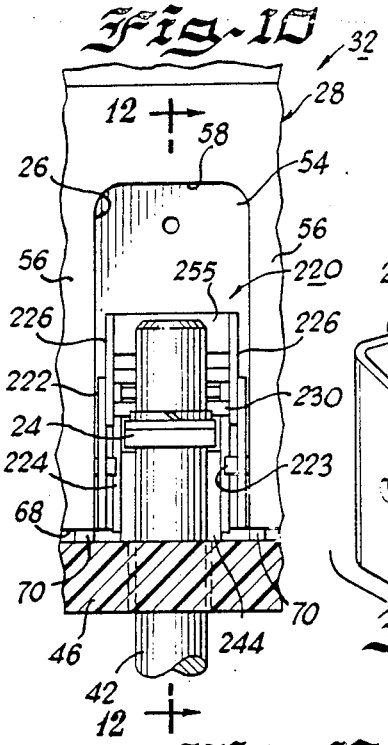
Fig-9
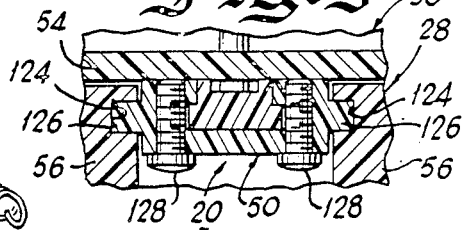
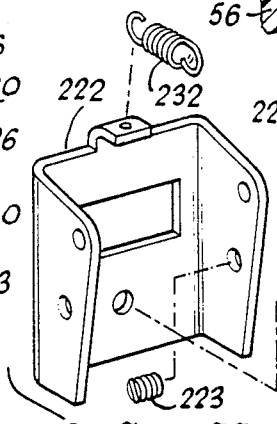
Fig-11
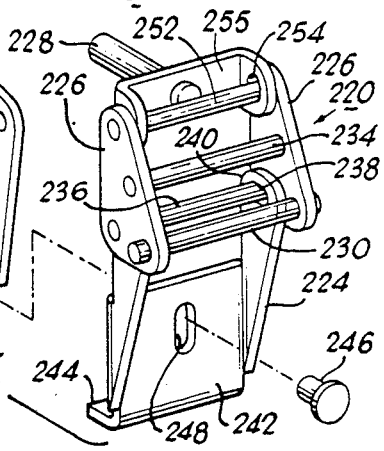
Fig-12
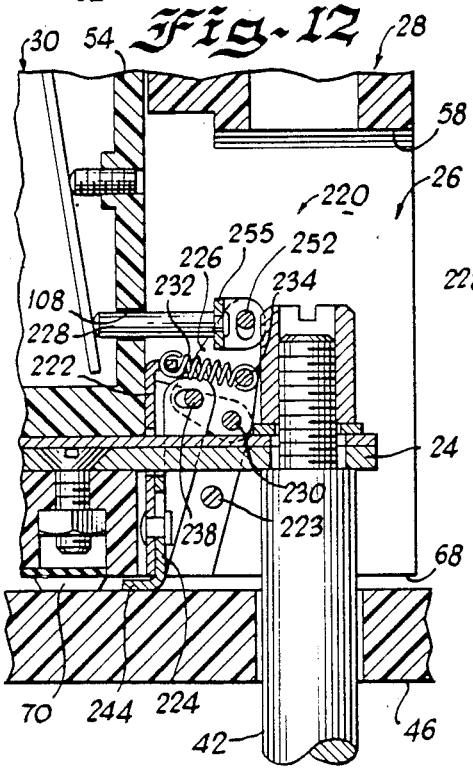
Fig-13
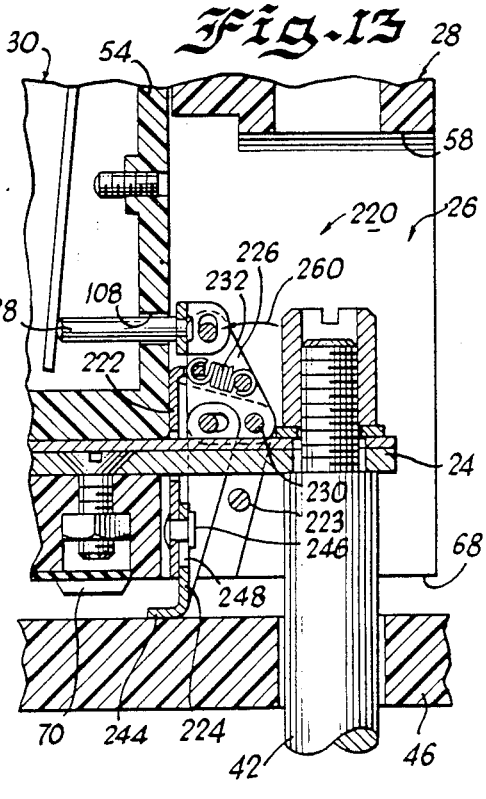

TRIP INTERLOCK DESIGN

CROSS REFERENCE TO RELATED APPLICATIONS

The invention disclosed herein relates to molded case circuit breakers. The following seven patent applications all relate to molded case circuit breakers and were filed on Aug. 1, 1988: Ser. No. 226,500, entitled RUBBER STOPS IN OUTSIDE POLES, William E. Beatty, Jr., Lawrence J. Kapples, Lance Gula and Joseph F. Changle, Westinghouse Case No. WE-54,532; Ser. No. 226,648, entitled CT QUICK CHANGE ASSEMBLY, by Jere L. McKee, William E. Beatty, Jr. and Glenn R. Thomas, Westinghouse Case No. WE-54,533; Ser. No 226,503, entitled CROSS-BAR ASSEMBLY, by Jere L. McKee, Lance Gula, and Glenn R. Thomas, Westinghouse Case No. WE-54,579; Ser. No. 226,649, entitled LAMINATED COPPER ASSEMBLY, by Charles R. Paton, Westinghouse Case No. WE-54,580; Ser. No. 226,650, entitled CAM ROLL PIN ASSEMBLY, by Lance Gula and Jere L. McKee, Westinghouse Case No. WE-54,594; Ser. No. 226,655, entitled COMBINATION BARRIER AND AUXILIARY CT BOARD by Gregg Nissly, Allen B. Shimp and Lance Gula, Westinghouse Case No. WE-54,821; and Ser. No. 226,654, entitled MODULAR OPTION DECK ASSEMBLY by Andrew J. Male, Westinghouse Case No. WE-54,822.

The following four commonly assigned U.S. patent applications were filed on Oct. 12, 1988 and all relate to molded case circuit breakers: Ser. No. 256,881 entitled SCREW ADJUSTABLE CLINCH JOINT WITH BOSSES, by James N. Altenhof, Ronald W. Crookston, Walter V. Bratkowski, and J. Warren Barkell, Westinghouse Case No. WE-54,694; Ser. No. 256,879 entitled TAPERED STATIONARY CONTACT LINE COPPER, by Ronald W. Crookston, Westinghouse Case No. WE-54,695; Ser. No. 256,880, entitled SIDE PLATE TAPERED TWIST-TAB FASTENING DEVICE FOR FASTENING SIDE PLATES TO THE BASE, by K. Livesey and Alfred E. Maier, Westinghouse Case No. WE-54,715; and Ser. No. 256,878, entitled TWO-PIECE CRADLE LATCH FOR CIRCUIT BREAKER, by Alfred E. Maier and William G. Eberts, Westinghouse Case No. WE-54,870.

The following commonly assigned U.S. patent applications also relate to molded case circuit breakers: Ser. No. 260,848, filed on Oct. 21, 1988, entitled UNRIVETED UPPER LINK SECUREMENT, by Joseph Changle and Lance Gula, Westinghouse Case No. WE-54,713I; Ser. No. 07/331,769, filed on Apr. 3, 1989, entitled ARC RUNNER CONTAINMENT SUPPORT ASSEMBLY, by Charles Paton, Kurt Grunert and Glen Sisson, Westinghouse Case No. WE-55,102; and Ser. No. 07/331,920, filed on Mar. 31, 1989, entitled EXTENDER SPRING FOR INCREASED MAGNETIC TRIP SETTINGS, by Kurt Grunert, Westinghouse Case No. WE-55,015.

The following two commonly owned U.S. patent applications were filed on Apr. 25, 1989: Ser. No. 07/343,047, entitled TWO-PIECE CRADLE LATCH, KEY BLOCKS AND SLOT MOTOR FOR CIRCUIT BREAKER, by Alfred E. Maier, William G. Eberts and Richard E. White, Westinghouse Case No. WE-54,870-I-1 and Ser. No. 07/342,820, entitled TWO-PIECE CRADLE LATCH, HANDLE BARRIER LOCKING INSERT AND COVER INTERLOCK FOR CIRCUIT BREAKER by A. D. Carothers, D. A. Parks, R. E. White and W. G. Eberts, Westinghouse Case No. WE-54,870-I-2.

Lastly, commonly owned U.S. patent application Ser. No. 07/374,370 was filed on June 30, 1989, entitled REVERSE SWITCHING MEANS FOR MOTOR OPERATOR, by Kurt Grunert and Charles Paton, Westinghouse Case No. WE-54,808.

BACKGROUND OF THE INVENTION

1. Field of the Invention

This invention relates to molded case circuit breakers and more particularly to a mechanical interlock which trips the circuit breaker any time it is lifted away from its panel mounting.

2. Description of the Prior Art

Molded case circuit breakers are generally old and well-known in the art. Examples of such circuit breakers are disclosed in U.S. Pat. Nos. 4,489,295; 4,638,277; 4,656,444 and 4,679,018. Such circuit breakers are generally used to protect electrical circuitry from damage due to an overcurrent condition, such as an overload and a relatively high level short circuit condition. An overload condition is normally 200 to 300 percent of the nominal current rating of the circuit breaker. A high level short circuit condition can be 1000 percent or more of the nominal current rating of the circuit breaker.

Molded case circuit breakers generally include at least one pair of separable main contacts which may be operated manually by way of an operating handle, extending outwardly from the circuit breaker case or automatically in response to an overcurrent or high level short circuit condition. In the manual mode and one automatic mode of operation, the separable main contacts are opened by an operating mechanism which, in turn, is actuated by either a trip unit in the automatic mode or the operating handle in the manual mode. In another automatic mode of operation, magnetic repulsion forces, generated between the stationary and movable contacts during relatively high level overcurrent conditions, can also cause the main contacts to be separated independently of the operating mechanism.

Molded case circuit breakers are generally provided with one or more line side terminals and one or more load side terminals. Oftentimes the line and load side terminals are provided with rear terminations to allow them to be plugged into corresponding receptacles on a circuit breaker panel. The line side receptacles on the circuit breaker panel are generally connected to a common source of electrical power. The load side receptacles on the circuit breaker panel are connected to various electrical loads.

Sometimes it is necessary to remove a circuit breaker from its panel mounting after it has been placed in service. For example, the circuit breaker may need to be removed for servicing or maintenance. Additionally, the circuit breaker may have to be removed and replaced with another circuit breaker with a different current rating due to a change in the load requirements.

Circuit breakers with plug in type rear terminations may be removed from the circuit breaker panel by unfastening the circuit breaker and pulling it outwardly from the panel. Such action will disconnect the circuit breaker load side and line side terminations from the corresponding receptacles on the circuit breaker panel. If the circuit breaker is on and is supplying electrical power to a load, electrical current will be flowing through the circuit breaker line side and load side terminations and corresponding receptacles on the circuit breaker panel. Should the circuit breaker be removed from its panel mounting while electrical current is flowing therethrough the electrical circuit would be broken between the terminations on the circuit breaker and the corresponding receptacles on the panel causing an arc to be drawn therebetween.

In many known circuit breakers, there are no means for automatically tripping the circuit breaker prior to its being removed from the panel. With such circuit breakers it is incumbent on the operator to manually trip the circuit breaker before removing it from the panel.

SUMMARY OF THE INVENTION

It is an object of the present invention to solve this problem associated with prior art circuit breakers.

It is another object of the present invention to provide means for automatically tripping the circuit breaker before it is removed from its panel mounting.

Briefly the present invention relates to a trip interlock assembly for tripping a circuit breaker any time the circuit breaker is removed from its panel mounting. The trip interlock assembly is adapted to be disposed adjacent a load side terminal and cooperate with the circuit breaker tripping means. In one embodiment, the trip interlock assembly includes a housing and a spring-loaded actuation arm, disposed generally perpendicular to the circuit breaker panel surface. The actuation arm is formed with a cam surface which cooperates with a trip pin, reciprocally mounted with respect to the circuit breaker tripping means. The trip pin acts as a cam follower and rides along the cam surface formed in the actuation arm. When the actuation arm is in an inward position indicating that the circuit breaker is mounted against a panel, the trip pin will not actuate the tripping means. However, when the circuit breaker is removed from the panel, the actuation arm, under the influence of a biasing spring moves outwardly, which, in turn, causes the cam surface on the actuation arm to move outwardly. This action causes the trip pin to move inwardly with respect to the trip unit and actuate the tripping means, which, in turn, trips the circuit breaker.

In an alternative embodiment of the invention, the trip interlock assembly includes a bell crank interlock with a reciprocally mounted plunger which actuates an armature in the tripping means directly instead of by way of the trip pin any time the circuit breaker is removed from its panel housing.

DESCRIPTION OF THE DRAWING

These and other objects and advantages of the present invention will become readily apparent upon consideration of the following detailed description and attached drawing, wherein:

FIG. 8 is similar to FIG. 3 showing an alternative embodiment of the mounting arrangement of the trip interlock assembly illustrated in FIGS. 1–7;

FIG. 9 is a plan sectional view similar to FIG. 5 showing the alternative mounting arrangement of the trip interlock assembly in accordance with the present invention;

FIG. 10 is an end elevational view similar to FIG. 2 showing an alternate embodiment of the trip interlock assembly in accordance with the present invention;

FIG. 11 is an exploded perspective view of the alternate embodiment of FIG. 10;

FIG. 12 is a cross-sectional view taken along line 12—12 of FIG. 10; and FIG. 13 is similar to FIG. 12 showing the trip interlock assembly in an actuated position.

DETAILED DESCRIPTION

Figure 1:
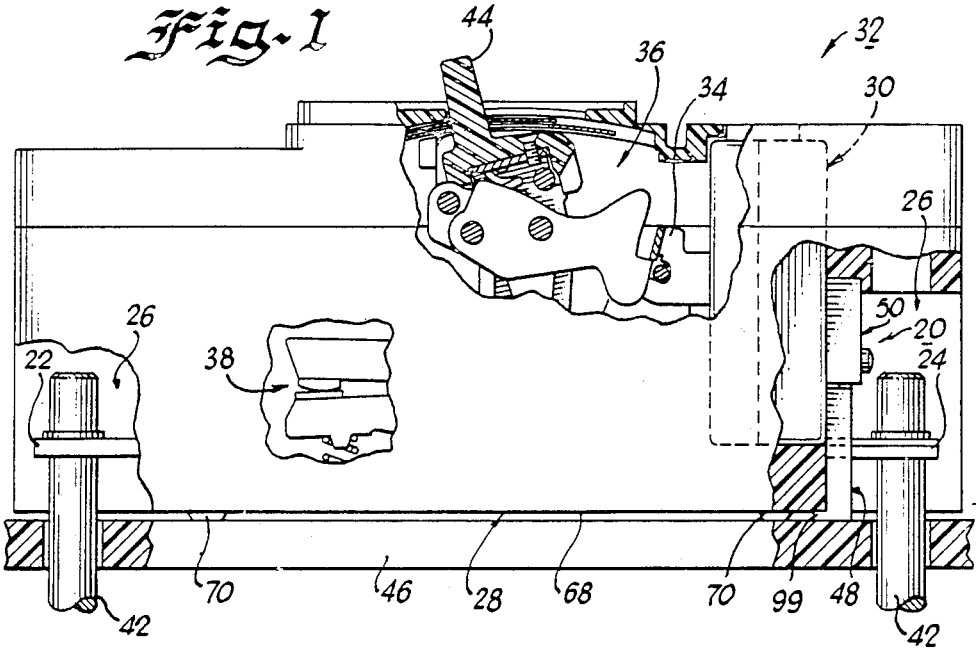
FIG. 1 is a side elevation, partially broken away view, of the trip interlock assembly of the present invention.
Figure 2:
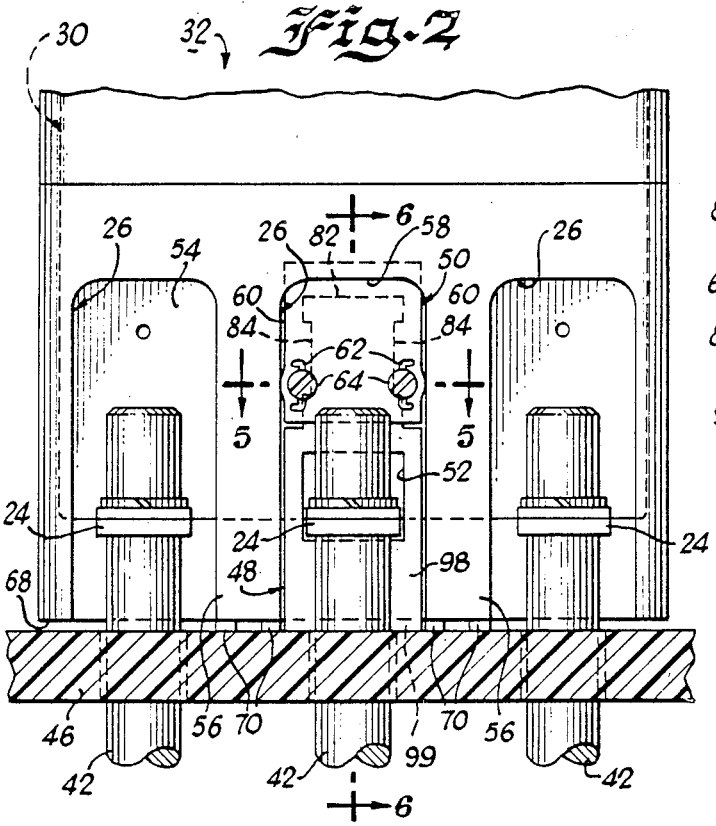
FIG. 2 is an end elevational view of the load side terminals of a circuit breaker.
Figure 3:
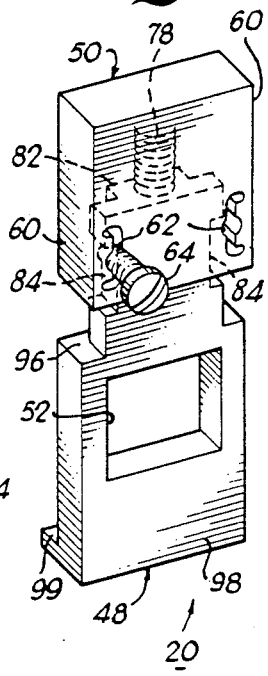
FIG. 3 is a perspective view of the trip interlock assembly in accordance with the present invention.
Figure 4:
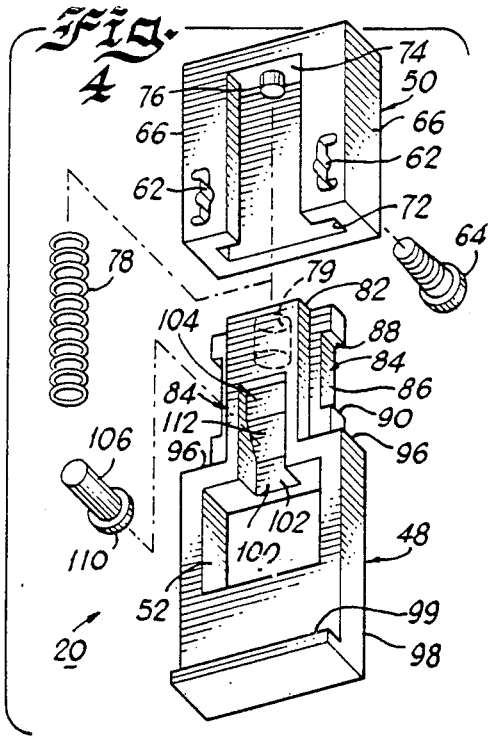
FIG. 4 is an exploded perspective view of the trip interlock assembly in accordance with the present invention.
Figure 5:
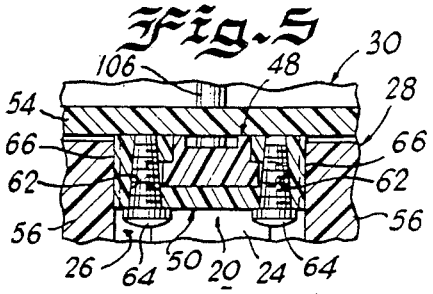
FIG. 5 is a plan sectional view taken along line 5—5 of FIG. 2.
Figure 5:
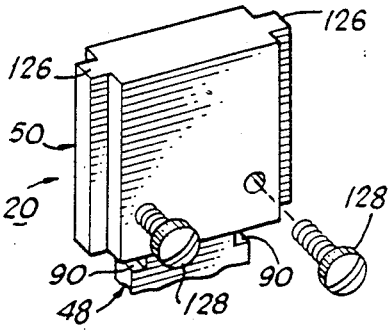

The trip interlock assembly in accordance with the present invention is generally identified with the reference numeral 20. The trip interlock assembly 20 is adapted to be disposed adjacent either a line side terminal 22 or a load side terminal 24 in a cavity 26, integrally formed in a circuit breaker housing 28. Since the trip interlock assembly 20 is mechanically interlocked with a circuit breaker tripping means 30, it is preferable that it be disposed adjacent the terminal closest thereto. Thus, the trip interlock assembly 20 is disposed adjacent the load side terminal 24 for the circuit breaker 32 shown.

As will be discussed in more detail below, the trip interlock assembly 20 may be added to a circuit breaker 32 in the field without any modification. Moreover, only one trip interlock assembly 20 is required per circuit breaker 32, irrespective of whether it is for a single pole breaker or a multi-pole breaker. The trip interlock assembly 20 cooperates with the tripping means 30 which trips all poles simultaneously. More specifically, the tripping means 30 includes a latch assembly 34 which under normal conditions latches a circuit breaker operating mechanism 36. Although the circuit breaker operating mechanism 36 does not form a portion of the present invention, it is described in detail in U.S. Pat. No. 4,642,430, assigned to the same assignee as the present invention and hereby incorporated by reference. The operating mechanism 36 generally includes an overcenter toggle mechanism (not shown) operatively coupled to one or more pairs of separable main contacts 38. When the circuit breaker 32 is removed from a panel 46, the trip interlock assembly 20 will actuate the tripping means 30 which will cause the latch assembly 34 to unlatch the operating mechanism 36 which, in turn, causes the overcenter toggle mechanism to collapse and separate the main contact 38.

The principles of the present invention are equally applicable to various types of tripping means 30. For example, some known circuit breakers are provided with non-adjustable thermal/magnetic tripping assemblies having a magnetic armature 40 and a bimetallic member (not shown) for each pole. Such assemblies are generally carried by the circuit breaker housing 28. Some tripping means 30 are adjustable to allow the thermal and magnetic trip ratings to be adjusted. In such tripping means 30, the magnetic armatures 40 and the bimetallic members are provided in a separate housing forming a modular unit and are adapted to be electrically connected to the load side terminals 24 and secured to the circuit breaker housing 28. Such modular tripping units are disclosed in U.S. Pat. Nos. 4,698,606 and 4,691,182, assigned to the same assignee as the present invention and hereby incorporated by reference. For brevity, only a modular trip unit 30 will be shown and described hereinafter.

As shown and described herein, the trip interlock assembly 20 is interlocked with the armature 40 of a modular trip unit 30. However, it should also be understood that the trip interlock assembly 20 may also be adapted to cooperate with a trip bar (not shown) which generally forms a portion of the operating mechanism 36 and functions to unlatch the latch assembly 34 to allow the separable main contacts 38 to be separated.

The trip interlock assembly 20 may be used on virtually any panel mounted circuit breaker 32. As shown in FIG. 1, the circuit breaker 32 is shown with line side and load side rear terminations 42. The line side rear terminations 42 are rigidly connected to the line side terminals 22. Similarly, load side rear terminals 42 are rigidly connected to the load side terminals 24. The rear terminations 42 extend outwardly from the circuit breaker housing 28, opposite the circuit breaker operating handle 44 and are adapted to be received in corresponding receptacles (not shown) in the circuit breaker panel 46. The line side receptacles in the circuit breaker panel 46 are electrically connected to a common source of electrical power while the load side receptacles are generally connected to various electrical loads, such as motors.

Some circuit breaker panels 46 are provided with receptacles which slidingly receive the terminations 42. In such applications the circuit breaker 32 can be removed from the panel 46 by removing fasteners (not shown) used to secure the circuit breaker 32 to the panel 46 and subsequently pulling the circuit breaker 32 away from the panel 46 causing the rear terminations 42 to disengage the receptacles. If the circuit breaker is on when an operator attempts to pull the circuit breaker 32 away from the panel 46, an electrical arc will be drawn between the rear terminations 42 and the corresponding receptacles in the circuit breaker panel 46. In order to avoid this arcing, it is necessary to trip the circuit breaker 32 before it is removed from the circuit breaker panel 46.

Heretofore, it has been incumbent upon the operator to manually trip the circuit breaker 32 by way of an operating handle 44 before removing the circuit breaker 32 from the circuit breaker panel 46. The trip interlock assembly 20 in accordance with the invention automatically trips the circuit breaker 32 whenever it is lifted away from a panel 46, thus obviating the need for the operator to manually trip the circuit breaker 32.

Two alternative trip interlock assemblies 20 and 220 are disclosed. The first embodiment, illustrated in FIGS. 1–9, is adapted to be used with circuit breakers 32 having trip units 30 requiring relatively little movement of the armature 40 to cause the circuit breaker 32 to trip; for example, $\frac{1}{8}''$. In other known circuit breakers, relatively more movement of the armature 40 is required to cause the circuit breaker 32 to trip; for example, $\frac{1}{4}''$ or more. In such applications, the distance that the circuit breaker 32 can be separated from the panel 46 before an arc is drawn between the rear terminals 42 and the corresponding receptacles in the panel 46 is less than the distance required to actuate the armature 40 in the trip unit 30. In these applications, it is necessary to amplify the movement of the circuit breaker 32 with respect to the panel 46. The alternative embodiment illustrated in FIGS. 10–13, is adapted to amplify such movement and actuate the trip unit 30.

The first embodiment of the trip interlock assembly 20 in accordance with the present invention is illustrated in FIGS. 1–9 may be formed from a dielectric material and is adapted to be disposed in a cavity 26, adjacent one of the load side terminals 24. The trip interlock assembly 20 is comprised of an actuation arm 48, slidably mounted with respect to a housing 50. The actuation arm 48 is provided with a centrally disposed aperture 52 to allow the actuation arm 48 to be disposed about a load side terminal 24 such that the longitudinal axis of the actuation arm 48 is generally perpendicular to the panel surface 46. In order to install the trip interlock assembly 20, it is necessary to remove one load side rear termination 42 to allow the trip interlock assembly 20 to be positioned about the load side terminal 24. The trip interlock assembly 20 is adapted to fit flush against an external wall 54 of the trip unit 30.

The width of the actuation arm 48 and corresponding housing 50 is slightly less than the distance between spaced apart wall portions 56 of the cavity 26. This prevents movement of the trip interlock assembly 20 in the transverse direction with respect to the circuit breaker housing 28. A top wall 58 of the circuit breaker cavity 26 forms one bearing surface for the trip interlock assembly 20. The circuit breaker panel 46 forms another bearing surface for the trip interlock assembly 20 when the circuit breaker is mounted against a panel 46.

In order to prevent movement of the trip interlock assembly 20 in the longitudinal direction with respect to the circuit breaker housing 28, the trip interlock assembly 20 is provided with a side thrust retainment feature. More specifically, a tapered slot 62 is formed in the housing 50, adapted to receive a tapered fastener 64. As the tapered fastener 64 is screwed into the slot 62, the housing 50 expands in the transverse direction causing side walls 66 of the housing 50 to be snugly secured against the spaced apart wall portions 56 of the cavity 26.

The length of the trip interlock assembly 20 is such to allow the circuit breaker 32 to be mounted relatively flush with the panel 46. More specifically, the rear surface 68 of the circuit breaker 32 is provided with a plurality of mounting feet 70, adapted to fit flush against the panel 46. The length of the trip interlock assembly 20 is such that the mounting feet 70 will fit flush with the panel 46 when the circuit breaker 32 is mounted to the panel 46.

Figure 7:
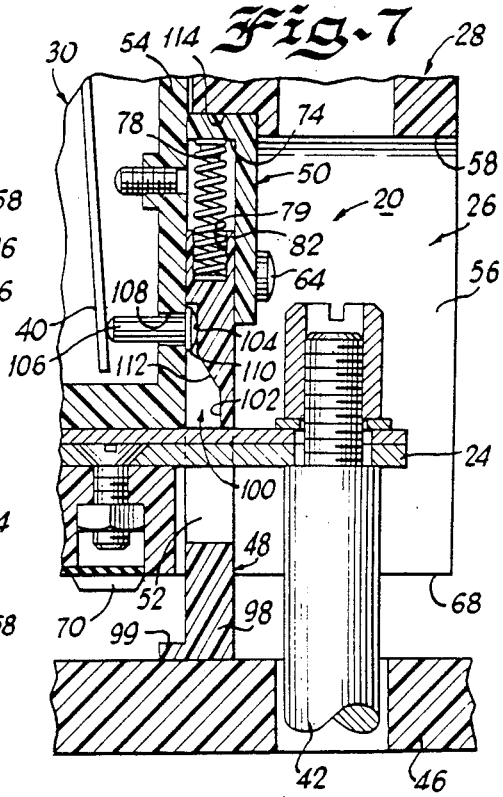
FIG. 7 is similar to FIG. 6 showing the circuit breaker removed from the panel.

The housing 50 is formed as a generally rectangular shaped member having a T-shaped slot 72 extending longitudinally therethrough. The T-shaped slot 72 allows the actuation arm 48 to be slidably received in the housing 50. An inner surface 74 of the housing 50 is provided with an upwardly extending protuberance 76 defining a spring retainer which acts to capture one end of a biasing spring 78. The other end of the biasing spring 78 is received in a longitudinally disposed bore 79 formed in a first portion 82 of the actuation arm 48. The biasing spring 78 serves to bias the actuation arm 48 outwardly. Thus, as shown in FIG. 7, when the circuit breaker 32 is removed from the panel 46, the actuation arm 48 will be in the position as shown.

In addition to securing the housing 50 of the trip interlock assembly 20 with respect to the cavity 26, the tapered fastener 64 also functions as a stop to limit outward movement of the actuation arm 48 with respect to the housing 50. More particularly, the first portion 82 of the actuation arm 48 is formed with two oppositely disposed U-shaped portions 84 defining a bight portion 86, a top leg portion 88 and a bottom leg portion 90. The contact of the top leg portion 88 with the tapered fastener 64 functions to limit outward movement of the actuation arm 48 with respect to the housing 50 and retains the actuation arm 48 within the housing 50.

Inward movement of the actuation arm 48 with respect to the housing 50 may be limited either by the bottom leg portion 90 engaging the tapered fastener 64 or by shoulders 96, formed in a second portion 98 of the actuation arm 48, engaging the housing 50. A foot 99, formed in the second portion 98 may also limit inward movement as it engages the housing 28. As will be discussed in detail below, the movement of the actuation arm 48 will allow a cam surface 100, integrally formed on the first portion 82 of the actuation arm 48, to be moved from a first cam position 102 to a second cam position 104 with respect to a trip pin 106.

Figure 6:
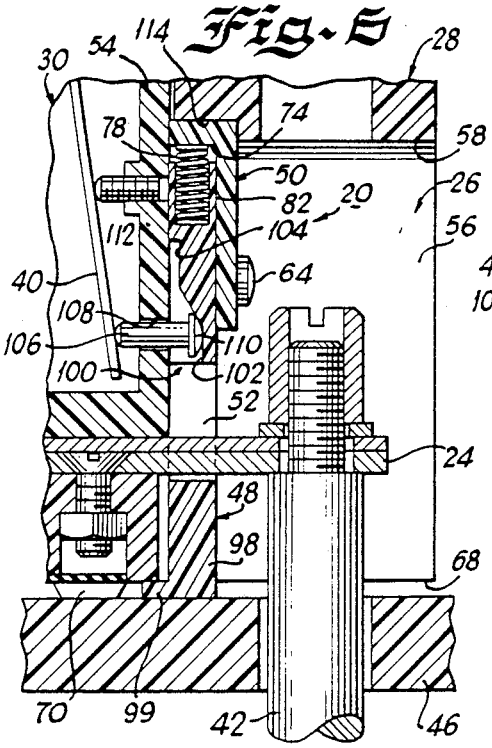
FIG. 6 is a cross-sectional view taken along line 6—6 of FIG. 2 before the circuit breaker is removed from the panel.

The trip pin 106 is disposed in an aperture 108 provided in the external wall 54 of the trip unit 30. The aperture 108 is located to allow the trip pin 106 to engage the armature 40 in the trip unit 30. As shown in FIG. 7, as the trip pin 106 moves to the left, this causes the armature 40 to move to the left which, in turn, unlatches the latch assembly 34 to allow the operating mechanism 36 to separate the main contacts 38. One end of the trip pin 106 is formed with a head 110. The head 110 acts as a cam follower and rides along the cam surface 100. As shown in FIG. 6, the head 110 is in engagement with the first cam position 102 when the circuit breaker 32 is mounted against the panel 46. Once the circuit breaker 32 is removed from the panel 46, the actuation arm 48 causes the second cam position 104 to engage the head 110 of the trip pin 106. This causes the trip pin 106 to be moved to the left which, in turn, causes the armature 40 to trip the circuit breaker 32.

The first cam position 102 and the second cam position 104 are formed as generally flat surfaces having a ramp interface 112 disposed therebetween. The longitudinal distance (with respect to the housing 28) between the first cam surface 102 and the second cam surface 104 dictates the amount of movement that the trip pin 106 will move.

In order to locate the trip interlock assembly 20 with respect to the aperture 108, the wall 58 of the cavity 26 is formed with a stepped surface 114 which properly positions the trip interlock assembly 20 with respect to the aperture 108. Additionally, the stepped surface 114 also serves to capture a top portion of the housing 50 to prevent longitudinal movement with respect to the circuit breaker housing 28.

As heretofore discussed, the actuation arm 48 is provided with a centrally disposed aperture 52. This aperture 52 allows the trip interlock assembly 20 to be received over a load side terminal 24. The length of the aperture 52 is such to allow movement the cam surface 100 from the first cam position 102 to the second cam position 104.

In order to provide strengthening of the actuation arm 48, the foot 99 is integrally molded and disposed adjacent the panel 46. In addition to strengthening the actuation arm 48, the foot portion 99 provides a relatively flat surface for engaging the circuit breaker panel 46.

An alternative mounting arrangement for the trip interlock assembly illustrated in FIGS. 1–7 is shown in FIGS. 8 and 9. In this embodiment, the wall portions 56 of the cavity 26 are provided with a pair of oppositely disposed slots 124. These slots 124 are adapted to receive a tongue portion 126 formed on the housing 50 to secure the trip interlock assembly 20 in both a longitudinal and transverse direction with respect to the circuit breaker housing 28. Fasteners 128 may also be used to secure the trip interlock assembly 20 with respect to the cavity 26.

For circuit breakers having tripping units 30 which require a relatively larger amount of travel of the armature 40, an alternative embodiment of the trip interlock assembly is provided, generally identified with the reference numeral 220. The trip interlock assembly 220 includes a bell crank assembly carried in a fixture 222 secured to the circuit breaker housing 28 with fasteners 223. The trip interlock assembly 220 includes a reciprocally mounted pushrod 224, a pair of pivotally mounted bell cranks 226 and a reciprocally mounted plunger 228. The bell cranks 226 are formed from generally triangular-shaped members and are pivotally mounted about a pin 230. A biasing spring 232 is connected between a pin 234, secured to the bell cranks 226 and the fixture 222 to bias the bell crank 226 in a counterclockwise direction (FIGS. 12 and 13).

Another outwardly extending pin 236 is disposed on the bell crank 226. The pin 236 is received in a transverse elongated slot 238, formed in the pushrod 224, disposed adjacent one end 240 of the pushrod 224. The elongated slot 238 allows the pushrod 224 to move rectilinearly to indicate when a circuit breaker 32 has been removed from a panel 46.

The other end 242 of the pushrod 224 is formed with a foot portion 244 for engaging the circuit breaker panel 46. The height of the foot portion 244 is such to correspond with the mounting feet 70, integrally formed on the circuit housing 28.

The pushrod 224 is disposed adjacent the circuit breaker housing 28. In order to stabilize movement of the pushrod 224 with respect to the circuit breaker housing 28, an outwardly disposed pin 246 is provided on the fixture 222 which cooperates with a slot 248 formed on the pushrod 224.

In operation, when the circuit breaker mounting feet 70 are flushly mounted against the panel 46, the pin 236 will engage the elongated slot 238. Once the circuit breaker mounting feet 70 are removed from the panel 46, the bell crank 226, under the influence of the biasing spring 232, will rotate in a counterclockwise direction, causing the pin 236 to push on the elongated slot 238 thus causing the pushrod 224 to move outwardly (FIG. 13) or away from the back surface of the circuit breaker housing 28. The counterclockwise movement of the bell crank 226 causes the pin 236 to move curvilinearly. This curvilinear movement of the pin 236 is translated to rectilinear movement of the pushrod 224 by way of the elongated slot 238.

Another pin 252 is provided on the bell crank 226 and received in a slot 254 provided on a U-shaped plunger mounting bracket 255. The plunger mounting bracket 255 is rigidly connected to the plunger 228. The plunger 228 is received in an aperture 108 in the exterior wall 54 of the trip unit 30.

As the bell crank 226 is rotated in a counterclockwise direction, the pin 252 engages an inside surface of the slot 254 to cause the pushrod 228 to move to the left (FIG. 13). Since the pin 252 moves in a curvilinear fashion as the bell crank 226 rotates about its pivot point 230. More specifically, as the pin 252 rotates about the pivot point 230, the pin 252 rotates about an arcuate path 260, shown dotted. This curvilinear motion is translated to rectilinear motion of the pushrod 228 by way of the slot 254.

It should be clear that the pin 252 travels a relatively larger distance than the distance that the pushrod 224 moves when the circuit breaker 32 is removed from the panel 46 before an arc is drawn between the rear terminations 42 and the corresponding receptacles in the panel 46. Thus, the trip interlock assembly 224 is able to amplify this lifting motion for circuit breakers having tripping units 30 requiring a relatively large movement of the armature 40, for example, ¼" or more in order to trip the circuit breaker 32.

Obviously many modifications and variations of the present invention are possible in light of the above teachings. Thus, it is to be understood that, within the scope of the appended claims, the invention may be practiced otherwise than as specifically described hereinabove.

What is claimed and desired to be secured by a Letters Patent is:

1. A circuit breaker comprising:
a housing adapted to be mounted to a panel;
one or more pairs of separable main contacts carried by said housing;
an operating mechanism, operatively coupled to said one or more pairs of separable main contacts;
one or more pairs of electrical terminals, electrically connected to said one or more pairs of separable main contacts disposed outwardly of said housing;
tripping means for tripping said circuit breaker, operatively coupled to said operating mechanism;
a trip pin which cooperates with said tripping means to cause said one or more pairs of separable contacts to be opened when said trip in is actuated; and
means for actuating said tripping means as said housing is moved away from said panel, wherein said actuating means includes an actuation arm housing, an actuation arm, a drive spring for biasing said actuation arm outwardly from said actuation arm housing and stop means for limiting the movement of said actuation arm with respect to said actuation arm housing.

2. A circuit breaker as recited in claim 1, wherein said actuation arm has a cam surface adapted to engage said trip pin when said actuating means is disposed in said housing.

3. A circuit breaker as recited in claim 1, wherein said actuation arm is an elongated member, generally rectangular in shape, having a first portion reciprocally mounted with respect to said actuation arm housing and a second portion, extending outwardly from said actuation arm housing and adapted to engage said panel.

4. A circuit breaker as recited in claim 3, wherein said actuation arm is such that its longitudinal axis is generally perpendicular to the surface of the panel.

5. A circuit breaker as recited in claim 1, wherein said actuation arm housing has a generally rectangular cross-section, open on one end for receiving said first portion of said actuation arm.

6. A circuit breaker as recited in claim 3, wherein said first portion of said actuation arm has a stop surface for limiting outward movement of said actuation arm.

7. A circuit breaker as recited in claim 3, wherein said first portion includes means for retaining one end of said drive spring.

8. A circuit breaker as recited in claim 7, wherein said retaining means includes a bore in an end of said first portion.

9. A circuit breaker as recited in claim 3, wherein said second portion has an aperture to allow it to be disposed about a line side terminal or a load side terminal.

10. A circuit breaker as recited in claim 1, wherein said actuation arm housing includes means for expanding said housing.

11. A circuit breaker as recited in claim 1, further including means for limiting inward movement of said actuation arm with respect to said actuation arm housing.

12. A circuit breaker comprising:
a housing adapted to be mounted to a panel;
one or more pairs of separable main contacts carried by said housing;
an operating mechanism, operatively coupled to said one or more pairs of separable main contacts;
one or more pairs of electrical terminals, electrically connected to said one or more pairs of separable main contacts, disposed outwardly of said housing;
tripping means for tripping said circuit breaker, operatively coupled to said operating mechanism, having an armature which causes said one or more pairs of separable main contacts to be opened when said armature is actuated; and
a bell crank means for reciprocatingly actuating said armature as said housing is moved away from said panel.

13. A circuit breaker as recited in claim 12, wherein said actuating means includes a bell.

14. A circuit breaker as recited in claim 12, wherein said bell crank means includes a pivotally mounted bell crank, a pushrod reciprocally mounted with respect to said bell crank and a reciprocally mounted plunger, defining a first position wherein said plunger is spaced away from said armature and a second position wherein said plunger is in engagement with said armature in said tripping means.

15. A circuit breaker as recited in claim 14, further including means for biasing said bell crank toward said second position.

16. A circuit breaker as recited in claim 14, further including means for converting curvilinear motion of said bell crank into rectilinear motion of said pushrod.

17. A circuit breaker as recited in claim 14, further including means for converting curvilinear movement of said bell crank into rectilinear movement of said plunger.

18. A molded case circuit breaker as recited in claim 12, wherein said tripping means includes a modular trip unit.

19. A molded case circuit breaker as recited in claim 18, wherein said modular tripping unit is a thermal magnetic unit.

* * * * *